United States Patent [19]

Polastri

[11] 4,006,020

[45] Feb. 1, 1977

[54] OVERCOATED ELECTROSTATOGRAPHIC PHOTORECEPTOR

[75] Inventor: John D. Polastri, Rochester, N.Y.

[73] Assignee: Xerox Corporation, Stamford, Conn.

[22] Filed: Mar. 13, 1975

[21] Appl. No.: 558,027

Related U.S. Application Data

[60] Continuation-in-part of Ser. No. 476,024, June 3, 1974, abandoned, which is a continuation-in-part of Ser. No. 474,296, May 29, 1974, abandoned.

[52] U.S. Cl. ..... 96/1.5; 96/1.8; 428/461

[51] Int. Cl.[2] ..... G03G 5/04

[58] Field of Search ..... 96/1.5, 1.8; 260/29.6 WB; 252/501

[56] References Cited

UNITED STATES PATENTS

| | | | |
|---|---|---|---|
| 2,829,025 | 4/1958 | Clemens et al. | 96/1.5 X |
| 3,140,174 | 7/1964 | Clark | 96/1.8 |
| 3,146,145 | 8/1964 | Kinsella | 96/1.5 X |
| 3,296,172 | 1/1967 | Funck et al. | 260/29.6 R |
| 3,607,258 | 9/1971 | Hoegl et al. | 96/1.5 |
| 3,617,265 | 11/1971 | Petruzella | 96/1.5 X |
| 3,753,709 | 8/1973 | Standenmayer et al. | 96/1.5 |
| 3,799,901 | 3/1974 | McCann et al. | 260/29.6 H |
| 3,847,606 | 11/1974 | Schwartz et al. | 96/1.5 |
| 3,856,458 | 12/1974 | Taylor et al. | 96/1.5 X |

*Primary Examiner*—Roland E. Martin, Jr.
*Attorney, Agent, or Firm*—James J. Ralabate; James Paul O'Sullivan; Jerome L. Jeffers

[57] ABSTRACT

Disclosed is an improved electrostatographic photoreceptor comprising a conductive substrate covered with an insulating photoconductive material having an organic overcoating on its surface. The overcoating material is a crosslinkable polymeric composition comprised of a first polymer which is the addition polymerization product of methyl methacrylate, n-butylacrylate and acrylic or methacrylic acid and a second polymer which is the addition polymerization product of styrene and maleic anhydride.

7 Claims, No Drawings

OVERCOATED ELECTROSTATOGRAPHIC PHOTORECEPTOR

BACKGROUND OF THE INVENTION

This application is a continuation-in-part of my copending application Ser. No. 476,024, filed on June 3, 1974, now abandoned, which is in turn a continuation-in-part of my copending application Ser. No. 474,296, filed May 29, 1974 now abandoned.

This invention relates to the art of electrostatographic copying, an electrostatographic photoreceptor and to a method of treating such a photoreceptor for use in electrostatographic copying machines. This form of copying, originally disclosed by C. F. Carlson in U.S. Pat. No. 2,297,691, involves, as an initial step, the uniform charging of a plate or drum comprised of a conductive substrate normally bearing on its surface a non-conductive barrier layer which is covered by a photoconductive insulating material. This is followed by exposing the plate or drum to activating radiation in imagewise configuration which results in dissipation of the electrostatic charge in the exposed areas while the non-exposed areas retain the charge in a pattern known as the latent image. The latent image is developed by contacting it with an electroscopic marking material commonly referred to as toner. This material is electrostatically attracted to the latent image which is, by definition, in the configuration of the portions of the photoreceptor which were not exposed to the activating radiation. The toner image may be subsequently transferred to paper and fused to it to form a permanent copy. Following this, the latent image is erased by discharging the drum and excess toner cleaned from it to prepare the drum for the next cycle.

The photoconductive insulating material is characterized in that it has a comparatively high electrical resistance in the dark which resistance decreases significantly upon exposure to activating radiation. Both organic materials, such as 2,4,7-trinitro-9-fluorenone in poly(vinylcarbazole), and inorganic materials, such as amorphous selenium, have been successfully used as the photoconductive material in electrostatographic copiers. It has been found to be desirable in some instances to overcoat the photoconductive material with certain substances either to protect it from physical damage or to facilitate the removal of toner during the cleaning step. Typical of overcoating materials are organic resins which form dielectric films and are transparent or translucent to the activating radiation. Overcoatings known to the art have not generally been regarded as contributing directly to improved copy quality. The present invention involves overcoating a photoreceptor with a material which not only protects the photoconductive material from abrasion and chemical contaminants in the ambient, but also enhances the quality of copies prepared from the overcoated photoreceptor. Copy enhancement is related to the formation of increased copy contrast and the reduction or elimination of the undesirable situation in which the copy suffers from background development.

Amorphous selenium has many desirable properties which render its use highly beneficial in electrostatographic copying machines. However, the advent of high speed copiers which make only one or two copies per drum revolution has necessitated the use of photoconductive materials which discharge at a faster rate than pure selenium. This is the case since the increase in copying speed is obtained by increasing the speed of drum revolution. Accordingly, the photoreceptor must go through the charge, expose, develop, transfer, discharge and clean cycle very rapidly. Researchers have discovered that the speed with which selenium can be put through this cycle can be increased by combining the selenium with arsenic to form an alloy. In addition, the use of selenium/arsenic alloys results in a photoreceptor which is sensitive to longer wavelengths of light. This concept is more fully disclosed by Ullrich in U.S. Pat. No. 2,803,542. Thus, selenium alloys containing from about 0.3 percent up to about 48.7 weight percent arsenic are advantageously used as the photoconductive material in high speed electrostatographic copiers. These arsenic containing selenium alloys have been found to suffer from a drawback which has come to be known as print deletion. This phenomena is observed as blank areas in the copy which get progressively larger until the copy quality becomes unacceptable. It is not fully understood what causes print deletion, but it is believed that materials found in the ambient of some locations where copiers are placed contain constituents which react with the arsenic in the photoconductor to form a conductive reaction product which allows the charge to dissipate immediately after the charging step. As a result, no latent image is formed in these areas and print deletion results.

Another drawback associated with the use of selenium/arsenic alloys as the photoconductive material in electrostatographic copying is long recovery time from light fatigue. Great care must be exercised to prevent the alloy from being exposed to light because such exposure will render the material non-photoresponsive for relatively long periods of time.

It would be desirable and it is an object of the present invention to provide a novel overcoating for electrostatographic photoreceptors.

An additional object is to provide such an overcoating which enhances the quality of copies produced by the overcoated photoreceptor.

Another object is to provide such an overcoating which reduces or eliminates the problems of copy deletion and light fatigue recovery associated with the use of selenium/arsenic alloys as photoconductors.

SUMMARY OF THE INVENTION

The present invention is directed to an improved electrostatic photoreceptor which comprises:

a. a conductive substrate;

b. a layer of an alloy of selenium and arsenic as a photoconductive insulating material in operative contact with the conductive substrate; and c. an organic overcoating on said photoconductive layer comprising a crosslinkable polymeric composition comprised of:

i. a first polymer which is the addition polymerization product of methyl methacrylate, n-butylacrylate and acrylic or methacrylic acid, and ii. a second polymer which is the addition polymerization product of styrene and maleic anhydride.

DETAILED DESCRIPTION AND PREFERRED EMBODIMENTS

The invention is predicated on the discovery that overcoating the photoconductive insulating layer of an electrostatographic photoreceptor with a thin but effective layer of the previously described overcoating material imparts unexpected beneficial properties to the photoreceptor. The improvements are related to overcoming the problems of copy deletion and slow recovery from light fatigue associated with the use of certain photoconductive alloys as well as generally improving copy quality.

Typical organic overcoating materials contemplated for use in the instant invention comprise the product of the addition polymerization of methyl methacrylate, n-butylacrylate and acrylic or methacrylic acid as the first polymer. The second polymer, sometimes referred to as the leveling resin, is the product of the copolymerization of styrene and maleic anhydride. In a typical overcoating, the first polymer will account for from about 75 to 90 mole percent of the film and will comprise from about 45 to 65 mole percent methyl methacrylate, 25 to 40 mole percent n-butylacrylate and 5 to 15 mole percent acrylic or methacrylic acid. The second polymer will normally account for from 10 to 25 weight percent of the film and will comprise styrene and maleic anhydride in a mole ratio of from 2:1 to 1:1. Since copolymers of styrene and maleic anhydride, usually referred to as SMA resins, typically contain a ratio of styrene to maleic anhydride of either 2:1 or 1:1, a composition in which the styrene to maleic anhydride ratio is between the extremes will necessarily contain a mixture of SMA resins. Those SMA resins having a 2:1 styrene/maleic anhydride ratio are generally preferred.

The overcoating is conveniently applied from a synthetic latex, i.e., a finely divided dispersion of polymer particles in an aqueous carrier. Typically the carrier will contain a basic material such as ammonia or an amine, e.g., ethylamine, isopropylamine, isobutylamine, etc., to form a salt with the weakly ionized carboxylic acid groups and thereby increase the solubility of the polymer. Such a latex dispersion is more fully described in U.S. Pat. No. 3,799,901.

Another method of preparing suitable latexes employing organic solvents such as alcohol and/or chlorinated hydrocarbons in combination with a basic material, e.g., an amine, is disclosed in U.S. Pat. No. 3,296,172. The polymer coatings are readily applied from their latex dispersions by applying a thin film to the photoreceptor surface and allowing the carrier to evaporate.

In order to incorporate toughness into the film formed by the latex dispersion, a metal crosslinking component is normally employed. Thus, by introducing a crosslinking material such as an oxide, hydroxide or salt of a polyvalent metal, e.g., zinc or zirconium, along with sufficient base to dissolve the aqueous dispersion of the polymer, the metal will serve to crosslink the polymer across carboxyl groups and form a tough film upon casting the solution. This crosslinking is ionic in nature and is believed to be represented by the following formula when ammonia is the base:

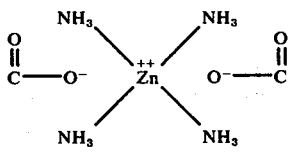

The use of metal crosslinking agents in conjunction with acrylic or methacrylic acid containing polymers is desirable due to the enhancement of the material's film forming capabilities achieved thereby. The incorporation of SMA resins into the polymer dispersion is especially advantageous when metal crosslinking agents are employed because the most serious problems with these systems is storage stability. This is the case because with no metal ions present, the solutions are somewhat susceptible to gelling and flocculation. The SMA resin acts as a leveling agent and serves the purpose of enhancing the freeze-thaw and heat stability of the coating formulation.

The aqueous latex solution will optionally contain, in addition to the two polymers, base and metal crosslinking agent, a volatile plasticizer. The plasticizer is normally present because of the desirability of formulating a material which upon application to the substrate will form a continuous film which exhibits a reasonably high level of abrasion resistance. In order to yield a continuous film, the coating composition must have a minimum film forming temperature (MFT) below the application temperature. In order for the dried film to wear well, its glass transition temperature (Tg) should be above its service temperature. Since minimum film forming temperature is a function of the polymer Tg and the plasticizer content, it is the practice of the coating industry to incorporate a volatile plasticizer into the formulation to obtain a low MFT (before plasticizer evaporation) and a high Tg (after plasticizer evaporation). Examples of volatile plasticizers, in their decending order of volatility, are pyrrole, propylene glycol, n-octanol, hexylene glycol, dipropylene glycol methyl ether, tributyl citrate and tributoxyethyl phosphate. In addition, caprolactam is sometimes employed to serve the dual function of a volatile plasticizer and gloss enhancer in commercially available floor finishes.

For purposes of the present invention, the thickness of the polymer coating is not critical, although it will be apparent to those skilled in the art that some experimentation may be required to determine the optimum coating thickness for a given photoconductive material. Typical coating thicknesses range from about 0.1 to about 10 microns.

As indicated above, the cause or causes of copy deletion are not fully known or understood. One form of copy deletion has been reproduced under controlled conditions. This form is known as amine induced copy deletion. It is believed that amines present in the ambient associated with high arsenic photoreceptors react with the surface of the photoreceptor to form a film which interferes with charge retention in this region and prevents a developable latent image from being formed. Application of a film of the type defined herein not only overcomes amine induced print deletion but print deletion caused by other detrimental materials present in certain ambients.

The invention is further illustrated by the following examples.

EXAMPLE I

An electrostatographic copying machine having as a photoreceptor an aluminum drum coated with an alloy of about 63 percent selenium and 37 percent arsenic on a weight basis is placed in a chamber having an atmosphere intentionally contaminated with cyclohexylamine. This atmosphere is known to cause copy deletion when the amine contacts the photoconductive alloy which effect is observed in about 2 hours time. One half of the photoreceptor is coated with Solarian Floor Finish obtained from The Armstrong Cork Co. in May of 1974. Analysis of the coating material indicates that it is a latex containing about 20 weight percent of solids comprising colloidal sized particles of from about 70 to 80 weight percent of a ternary copolymer of from 45 to 65 percent methyl methacrylate, 25 to 40 percent n-butylacrylate and 5 to 15 percent methacrylic acid. In addition, there is present from 8 to 23 weight percent of an SMA resin in which the mole ratio of styrene to maleic anhydride is 2:1. A small amount of zinc is present as crosslinking agent. The formulation is also found to contain 1 to 2 percent tributoxyethyl phosphate, 4 to 6 percent caprolactam (monomer), 1 to 2 percent glycine, 0.5 percent ammonia and about 1 percent diethylamino ethanol. Since the plasticizers (tributoxyethyl phosphate, caprolactam), gloss enhancing agents (caprolactam, glycine) and emulsifying agents (ammonia, diethylamino ethanol) do not play a part in the xerographic process, their presence is not required after the film is laid down and other materials can be substituted to serve their functions.

The coating is accomplished by applying a sponge containing the material to the drum surface and rotating the drum several times while moving the sponge parallel to the axis of rotation. After application, the layer is carefully dried to form a substantially uniform film.

After 2 hours of copying using the machine in the normal xerographic mode in which the machine is rested for 5 minutes between each fourth copy, a progressively worsening copy deletion effect is observed on the uncoated side of the photoreceptor. Conversely, no copy deletion is observed on the side of the photoreceptor having the overcoating. Thirty thousand copies are made using the treated photoreceptor without any sign of copy deletion on the overcoated side.

EXAMPLE II

An uncoated photoreceptor such as that described in Example I is exposed to fluorescent laboratory lighting for about 45 minutes. The drum is reinserted into a copier and operated in the normal xerographic mode. The photoreceptor does not respond normally due to light fatigue of the photoconductor. Extremely light, low contrast copies resulted from the light fatigued plate. This condition continued through about 100 copies with no improvement at which point the experiment was terminated. Only after being stored for several hours in the dark does the photoreceptor operate with its normal contrast.

The photoreceptor described in Example I is overcoated with Solarian as previously described and exposed to the same laboratory lighting for about 45 minutes. Upon reinserting the photoreceptor into the copier it is discovered that after about 3 copies the photoconductive material exhibits normal high contrast photoresponse. This rapid recovery and quick stabilization will permit all electricals of the machine to be set minutes after reinsertion of the drum into the copier. This is a significant additional unexpected advantage of the overcoating of the present invention.

Electrostatographic copies made using photoreceptors overcoated according to the present invention are superior to those made using an unovercoated photoreceptor both in terms of reduced background development and greater contrast between the image and background areas of the copies.

EXAMPLE III

The photoreceptor described in Example I is coated in a similar manner as that described in Example I with a commercially available floor finish containing:

a. a metallized acrylic/styrene copolymer,
b. an alkali-soluble maleic resin, and
c. polyethylene wax.

This material, which is marketed by S. C. Johnson & Sons, Inc., of Racine, Wisc., under the tradename Super Glo Coat, is applied from an aqueous dispersion containing a glycol ether, tributoxyethyl phosphate, formaldehyde and traces of surfactants.

This coating material is readily applicable to the drum in the sense that it can be applied to form an even coating. However, copies made from the coated drum are unacceptable due to the presence of high background and fuzzy images. Copy quality is definitely inferior to that obtained with an uncoated drum and is in sharp contrast to the quality of copies obtained using the drum coated with the coating material described in Example I which are clearly superior to copies made using an uncoated drum.

The photoconductors which can be coated by the process of the present invention are not limited to those specifically disclosed, i.e., high arsenic/selenium alloy photoconductors, but include photoconductors broadly. Thus, for example, enhancement in copy quality can be achieved by coating photoreceptors in which the photoconductive material is an organic material, e.g., TNF in poly(vinylcarbazole), or an inorganic photoconductor in an insulating organic resin such as CdSSe in polyurethane. In the above examples, the organic overcoating is applied from an aqueous solution containing colloidal sized particles of the resinous material. It is not critical that the overcoating be applied in this manner and other coating methods apparent to those skilled in the art may be employed.

What is claimed is:

1. An electrostatographic photoreceptor which comprises:

a. a conductive substrate;
b. a layer of an alloy of selenium and arsenic as photoconductive insulating material in operative contact with the conductive substrate; and
c. an organic overcoating on said photoconductive layer comprising a crosslinkable polymeric composition comprised of:
   i. a first polymer which is the addition polymerization product of methyl methyacrylate, n-butylacrylate and acrylic or methacrylic acid; and
   ii. a second polymer which is the addition polymerization product of styrene and maleic anhydride.

2. The photoreceptor of claim 1 wherein the alloy contains from about 0.3 to about 48.7 weight percent arsenic.

3. The photoreceptor of claim 2 wherein the alloy comprises about 63 percent selenium and 37 percent arsenic.

4. An electrostatographic photoreceptor which comprises:

a. a conductive substrate;
b. a layer of a photoconductive insulating material in operative contact with the conductive substrate which photoconductive material is an alloy comprising from about 0.3 to about 48.7 weight percent arsenic with the remainder being essentially amorphous selenium; and c. an organic overcoating on said photoconductive layer comprising a crosslinkable polymeric composition comprised of:

i. 75 to 90 weight percent of a first polymer which is the addition polymerization product of from about 45 to 65 mole percent methyl methacrylate, 25 to 40 mole percent n-butylacrylate and 5 to 15 mole percent acrylic or methacrylic acid; and ii. 10 to 25 weight percent of a second polymer which is the addition polymerization product of styrene and maleic anhydride wherein the mole ratio of styrene to maleic anhydride is from 2:1 to 1:1.

5. The photoreceptor of claim 4 wherein the alloy contains about 63 percent selenium and about 37 percent arsenic; the first polymer contains methacrylic acid and the ratio of styrene to maleic anhydride is 2:1.

6. The photoreceptor of claim 5 wherein the carboxyl groups of the methacrylic acid are crosslinked with either zinc or zirconium.

7. The photoreceptor of claim 6 wherein the crosslinking metal is zinc.

* * * * *